US007343112B2

(12) United States Patent
Ito et al.

(10) Patent No.: US 7,343,112 B2
(45) Date of Patent: Mar. 11, 2008

(54) IMAGE FORMING APPARATUS USING HYPOCHROMATIC TONER AND HYPERCHROMATIC TONER

(75) Inventors: Nobuyuki Ito, Shizuoka (JP); Takeshi Ikeda, Shizuoka (JP); Yukio Nagase, Shizuoka (JP); Isami Itoh, Shizuoka (JP); Yasukazu Ayaki, Kanagawa (JP); Tomohito Ishida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 947 days.

(21) Appl. No.: 10/760,316

(22) Filed: Jan. 21, 2004

(65) Prior Publication Data

US 2005/0018218 A1 Jan. 27, 2005

(30) Foreign Application Priority Data

Jan. 27, 2003 (JP) ..... 2003-017238

(51) Int. Cl.
*G03G 15/00* (2006.01)
*G03G 15/01* (2006.01)

(52) U.S. Cl. ..... 399/49; 399/227

(58) Field of Classification Search ..... 399/49, 399/227; 358/1.7, 1.9
See application file for complete search history.

(56) References Cited

U.S. PATENT DOCUMENTS

| | | | | |
|---|---|---|---|---|
| 6,013,403 | A | 1/2000 | Ichikawa | 430/97 |
| 6,327,450 | B1 | 12/2001 | Ito | 399/227 |
| 6,498,910 | B2 | 12/2002 | Haneda | 399/51 |
| 6,996,358 | B2 * | 2/2006 | Ayaki et al. | 430/45.4 |

FOREIGN PATENT DOCUMENTS

| | | | |
|---|---|---|---|
| EP | 0 401 023 | A2 | 5/1990 |
| EP | 1 376 255 | A2 | 1/2004 |
| JP | 58-39468 | | 3/1983 |
| JP | 11-84764 | | 3/1999 |
| JP | 2000-231279 | | 8/2000 |
| JP | 2000-305339 | | 11/2000 |
| JP | 2000-347476 | | 12/2000 |
| JP | 2001-290319 | | 10/2001 |
| JP | 2002-144250 | | 5/2002 |
| JP | 2004133381 | A * | 4/2004 |
| WO | WO 96/32812 | | 10/1996 |

OTHER PUBLICATIONS

Patent Abstracts of Japan, Publication No. 2000-347475, Dec. 15, 2000.
Patent Abstracts of Japan, Publication No. 2001-290319, Oct. 19, 2001.

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

The image forming apparatus has an image forming portion capable of forming an image on a transferring medium by the use of a hypochromatic toner and a hyperchromatic toner of substantially the same color. The image forming portion is provided with a developing device for developing with the hypochromatic toner and the hyperchromatic toner, wherein, in an image area in which the hyperchromatic toner and the hypochromatic toner are mixedly present, the recording rate of the hyperchromatic toner is 1/16, the minimum size Wmini of a toner image of the hyperchromatic toner is 50 μm or less on the transferring medium. Thereby, it is achieved to reduce graininess.

7 Claims, 10 Drawing Sheets

FIG. 5A
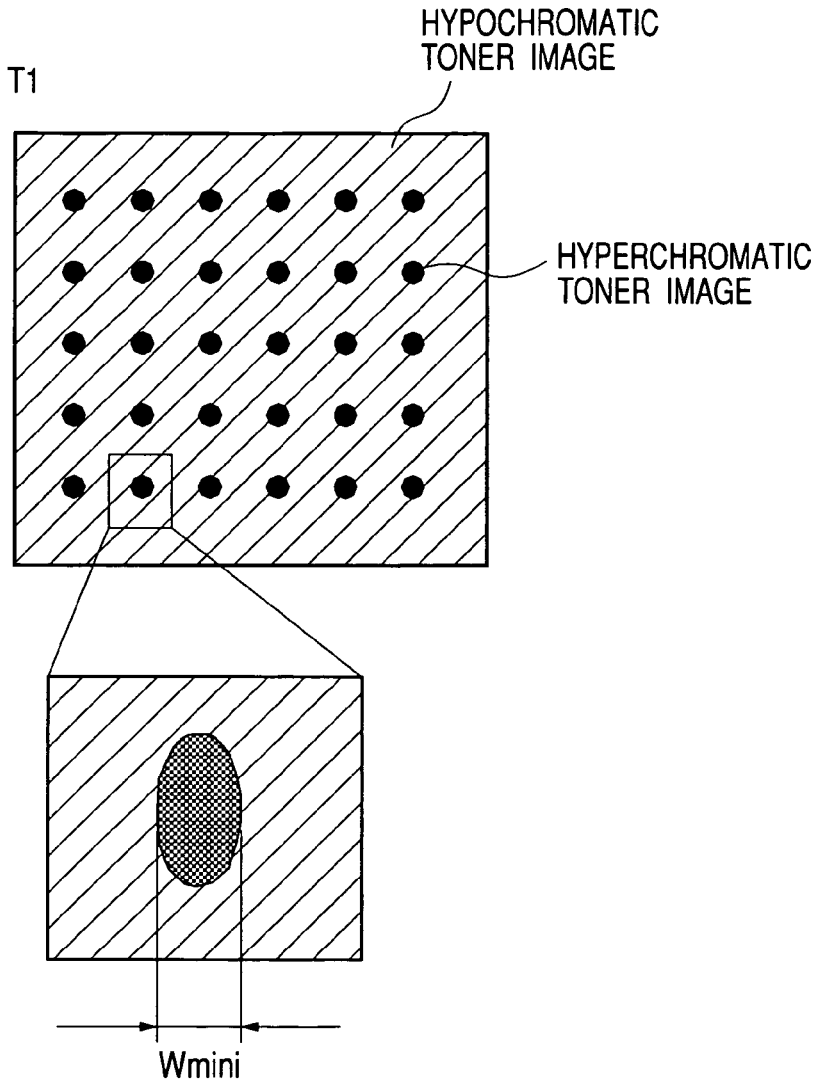
FIG. 5B
FIG. 5C
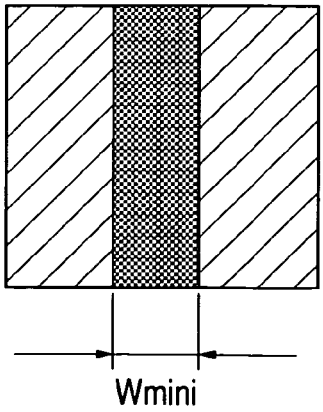
FIG. 5D
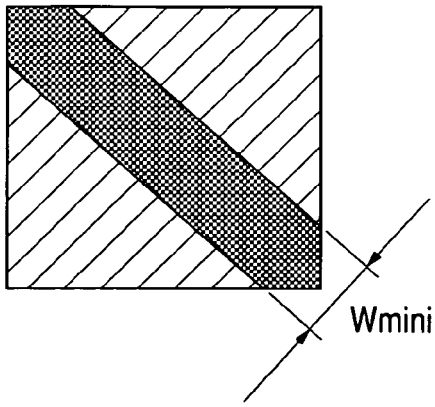

FIG. 9

HYPOCHROMATIC TONER LIGHTNESS VALUE AT THE TIME WHEN HYPERCHROMATIC TONER IS MIXED IN HYPOCHROMATIC TONER

HYPERCHROMATIC TONER DOT DIAMETER Wmini

| | 20 μm | 30 μm | 40 μm | 50 μm | 60 μm | 70 μm |
|---|---|---|---|---|---|---|
| 85 | ◎ / ◎ | ◎ / ◎ | ◎ / ◎ | ◎ / ◎ | × / ◎ | × / ◎ |
| 80 | ◎ / ◎ | ◎ / ◎ | ◎ / ◎ | ◎ / ◎ | × / ◎ | × / ○ |
| 75 | ◎ / ◎ | ◎ / ◎ | ◎ / ◎ | ◎ / ◎ | × / ○ | × / ○ |
| 70 | ◎ / ◎ | ◎ / ◎ | ◎ / ◎ | ◎ / ◎ | × / ○ | × / △ |
| 65 | ◎ / ◎ | ◎ / ○ | ◎ / ○ | ◎ / ○ | △ / △ | △ / △ |
| 60 | ◎ / △ | ◎ / △ | ◎ / △ | ◎ / △ | △ / △ | ◎ / △ |
| 55 | ◎ / △ | ◎ / △ | ◎ / × | ◎ / × | ◎ / × | ◎ / × |
| 50 | ◎ / × | ◎ / × | ◎ / × | ◎ / × | ◎ / × | ◎ / × |

GRANULATION OF ACCOUPLEMENT

ROUGH IMAGE ON HILIGHT

IMAGE FORMING APPARATUS USING HYPOCHROMATIC TONER AND HYPERCHROMATIC TONER

BACKGROUND OF THE INVENTION

1. Field of the Invention

This invention relates to an image forming apparatus such as a copying machine, a printer or a facsimile apparatus for effecting color image forming by the utilization of an electrophotographic process.

2. Description of Related Art

As an image forming apparatus for forming a color image, for example, an image forming apparatus for successively superimposing and transferring toner images of respective colors formed on a photosensitive drum which is an image bearing member onto a transferring material such as paper held on a transferring drum (transferring film) has been put into practical use.

In such an image forming apparatus, an electrostatic latent image formed on a photosensitive drum on the basis of an inputted image signal is developed by a toner of a first color (e.g. cyan) to thereby form a toner image, and this toner image is transferred to a transferring material such as paper held on a transferring drum (transferring film). This transferring step is likewise executed for toners of the other three colors, i.e., magenta, yellow and black, and toner images of four colors are successively superimposed and transferred onto the transferring material, whereby a color image can be obtained.

In the latest image forming apparatus of an electrophotographic type using a digital image signal, the latent image is formed by dots of predetermined potential gathered on the surface of a latent image bearing member, i.e., a so-called photosensitive member, and a solid portion, a halftone portion and a line portion are expressed by changing dot density.

This method, however, is liable to give rise to the problem that it is difficult for toner particles to faithfully adhere to the dots and the toner particles become protruded from the dots, and the gradation of a toner image corresponding to the ratio of dot density between the black portion and white portion of a digital latent image cannot be obtained.

Further, when the dot size is to be made small to thereby improve resolution in order to improve the quality of image, the reproducibility of the latent image formed by minute dots becomes more difficult, and this leads to the tendency that the resultant image becomes an image inferior in resolution and particularly the gradation of a hilight portion and lacking in sharpness. Also, the disturbance of irregular dots is felt as a sense of granuation, and becomes a factor which deteriorates the quality of image of the hilight portion.

Such disturbance does not occur to ink jet and printing, and particularly the greatest problems peculiar thereto are the fact that it is an unforeseeable unstable factor of the quality of image, and a low-frequency noise macroscopically caused by a toner image being formed with numerous minute toner particles having a particle diameter of 5 to 10 μm being distributed at random in the outlines of the dots.

When an electrophotographic image is magnified by a loupe or the like and observed therethrough, it will be seen that in the case of electrophotography, a dot, even if called so, is not of a smooth configuration like ink jet, but is formed by numerous minute toner particles having a particle diameter of 5 to 10 μm being distributed at random in the outline of the dot. Further, the finish of dots is not uniform, but there are dots low in toner density forming the dots or high in such toner density (fluctuation in the toner density forming the dot), dots small in dot area and large in dot area (fluctuation in dot area), and dots not only of a circular shape but also of an oval shape (fluctuation in dot shape), and they are not just alike. The unevenness of these factors is substantially random and includes considerable low frequency components. As a result, it is a visible cause of noise.

It is the difference between the toner density and the density of paper that makes this noise conspicuous. As compared particularly with ink jet, electrophotography is subjected to the influence of optical dot gain by the distribution of numberless minute toner particles.

The main cause of the above-described phenomenon is that in the electrophotographic process, minute toner particles are used to form dots. Also, other causes promoting the phenomenon include the unsharpening of dot data in the process from a latent image to transferring through developing in the electrophotographic process, the irregular scattering of the toner attributable to the values of physical properties (electrical resistance and surface roughness) of copy paper, etc., and a phenomenon attributable to an adhering force in the developing process which will hereinafter be described.

The adhering force (chiefly the reflection force of the toner to a developer carrying member) between the toner and a developing sleeve in the case of a monocomponent developer, and between the toner and the carrier in the case of a two-component developer is strong, while on the other hand, the distribution of the charging amount of the toner is uneven and therefore, when these are to be stripped off by a developing bias and be made to fly to a photosensitive drum, there occurs unstable image forming in which it is easy for the toner at one place to fly and it is difficult for the toner at another place to fly, and unevenness occurs to dot forming.

On the other hand, a gradation ink process in the ink jet process disclosed in Japanese Patent Application Laid-Open No. 58-39468 is free from such problems peculiar to electrophotography as noted above because the ink jet process itself is simple and moreover, the performance of exclusive paper supporting the present high quality of image is excellent.

Therefore, it has been found that as compared with the effect of the gradation ink used in an ink jet printer or the like for the improvement in graininess, in the electrophotographic process, the effect of the use of a light-colored toner to the aforementioned observable low-frequency noize attributable to the "fluctuation in the toner density forming dots", the "fluctuation in dot area" and the "fluctuation in dot shape" is more superb than ink jet.

Moreover, in the point that the optical dot gain which has posed no problem in the ink jet process has been a great hindrance to aiming at a high quality of image in the electrophotographic process using numberless minute toner particles, the introduction of the light-colored toner into the electrophotographic process has brought about great progress.

Accordingly, with the view of solving the above-noted problems, there has been proposed a method of forming an image by using a light-colored toner (hypochromatic toner) for a hilight portion and a dark-colored toner (hyperchromatic toner) for a solid portion. For example, in Japanese Patent Application Laid-Open No. H11-84764 and Japanese Patent Application Laid-Open No.2000-305339, there is proposed an image forming method of forming an image by combining a plurality of toners differing in density from one another. In Japanese Patent Application Laid-Open No.2000-347476, there is proposed an image forming apparatus in which a hypochromatic toner having maximum reflection density equal to or less than a half of the maximum reflection density of a hyperchromatic toner is combined with the hyperchromatic toner. In Japanese Patent Application Laid-Open No. 2000-231279, there is proposed an image forming apparatus in which a hyperchromatic toner of which the image density when the amount of toner on a transferring material is 0.5 mg/cm$^2$ is 1.0 or greater and a hypochromatic toner of which the image density in the above-mentioned case is less than 1.0 are combined together. In Japanese Patent Application Laid-Open No. 2001-290319, there is proposed an image forming apparatus in which a hyperchromatic toner and a hypochromatic toner between which the gradient ratio of recording density is between 0.2 to 0.5 are combined together.

In the case of the prior art as described above, however, there has arisen the following problem.

That is, according to my studies, by the hypochromatic toner being used, the gradation property and granular feeling in a low density area constituted by the hyperchromatic toner alone are improved, there has arisen the problem that the granular feeling in a medium density area wherein the hyperchromatic toner and the hypochromatic toner are mixedly present rather becomes remarkable.

The cause of this is that the state in which a slight amount of hyperchromatic toner is present in the hypochromatic toner is an image which is very unstable in process conditions, but is visually very sensitive.

An ink jet printer using the existing six-color (gradation) ink has solved this problem by finely controlling the discharge amount of the ink, but in an electrophotographic apparatus, this instability has been a great hindrance when a gradation system is adopted.

Accordingly, to solve this problem, the fineness or stabilizations of the image output of the hyperchromatic toner must first be controlled more severely than before.

SUMMARY OF THE INVENTION

It is an object of the present invention to provide an image forming apparatus which achieves a reduction in graininess.

It is another object of the present invention to provide an image forming apparatus which can accomplish smooth gradation expression in a halftone area.

It is another object of the present invention to provide an image forming apparatus which, when an image in which a hypochromatic toner and a hyperchromatic toner are mixedly present is formed, reduces the visual conspicuity of dots of the hyperchromatic toner.

It is another object of the present invention to provide an image forming apparatus having good gradation reproducibility in all gradation areas.

Further objects and features of the present invention will become more apparent from the following detailed description when read with reference to the accompanying drawings.

BRIEF DESCRIPTION OF THE DRAWINGS

FIGS. 5A is a typical view of an image patch in which hyperchromatic and hypochromatic toners are mixedly present, and FIGS. 5B, 5C and 5D show an example of the definition of the minimum dot size Wmini of the hyperchromatic toner.

FIG. 9 is a table summing up the subjective evaluation of graininess when a hyperchromatic toner gets mixed in a hypochromatic toner.

DETAILED DESCRIPTION OF THE PREFERRED EMBODIMENTS

Some preferred embodiments of the present invention will hereinafter be described in detail by way of example with reference to the drawings. The dimensions, materials, shapes, relative arrangement, etc. of constituent parts described in these embodiments, unless otherwise specified, are not intended to restrict the scope of the present invention thereto.

Figure 1:
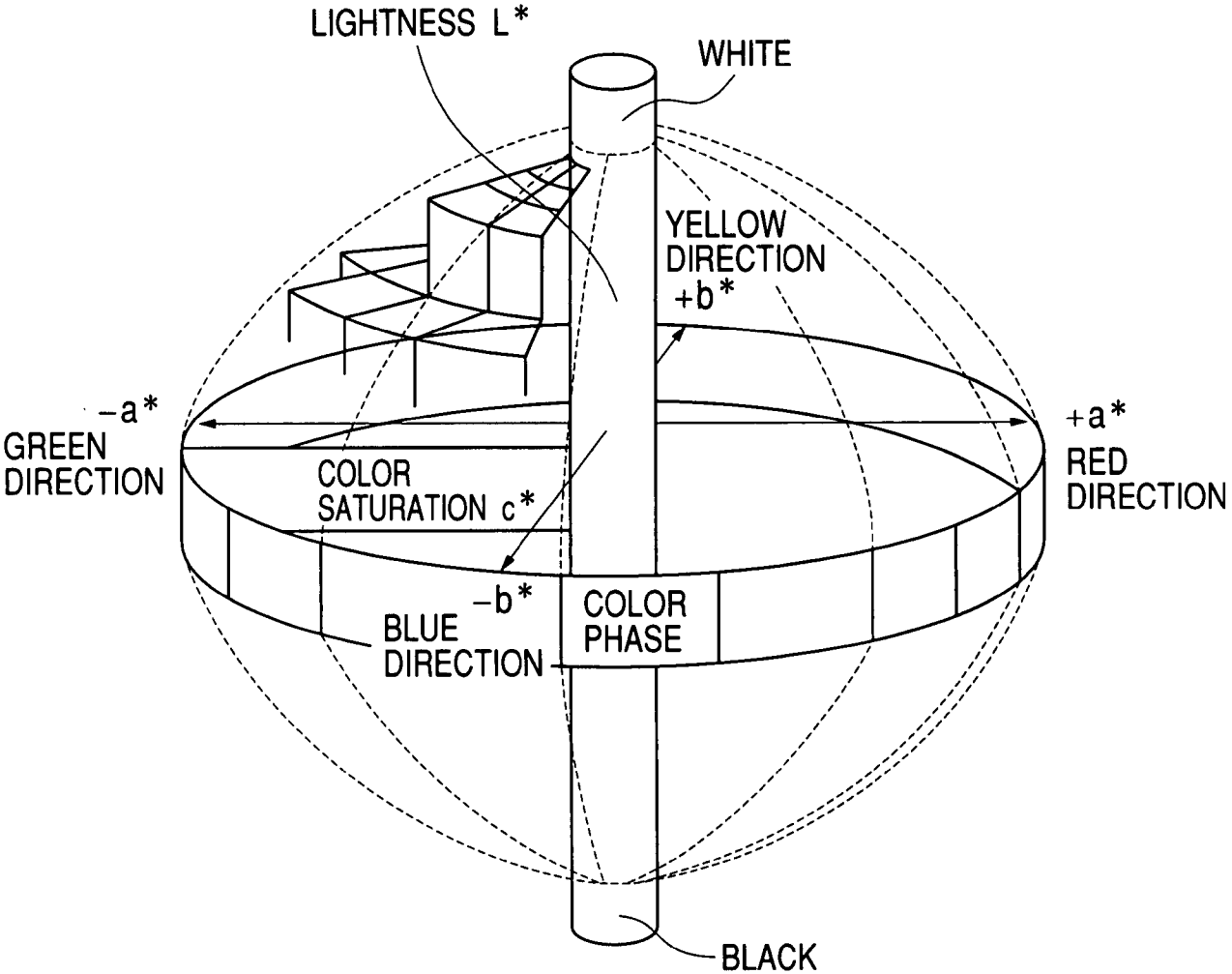
FIG. 1 is a stereoscopic conceptional view for illustrating L*a*b* color system.

In the following embodiments, L* is a value generally used as L*a*b* color system, and is means useful for expressing colors by numerical values. This is a color space recommended by committee of International Electrolier (CIE) in 1976, and is called CIE 1976 (L*a*b*) color system, and is abbreviated as CIELAB. According to Japan Industrial Standard, it is prescribed as JISZ8729. FIG. 1 is a stereoscopic conceptional view for illustrating the L*a*b* color system. In FIG. 1, a* and b* on the axis of abscissas together represent a color phase. The color shape is a measure of hues such as red, yellow, green, blue and purple. L* on the axis of ordinates represents lightness, and indicates the degree of lightness of a color comparable independently of the color phase. a* and b* indicate the directions of colors, and a* represents red-green direction, and b* represents yellow-blue direction.

Figure 2:
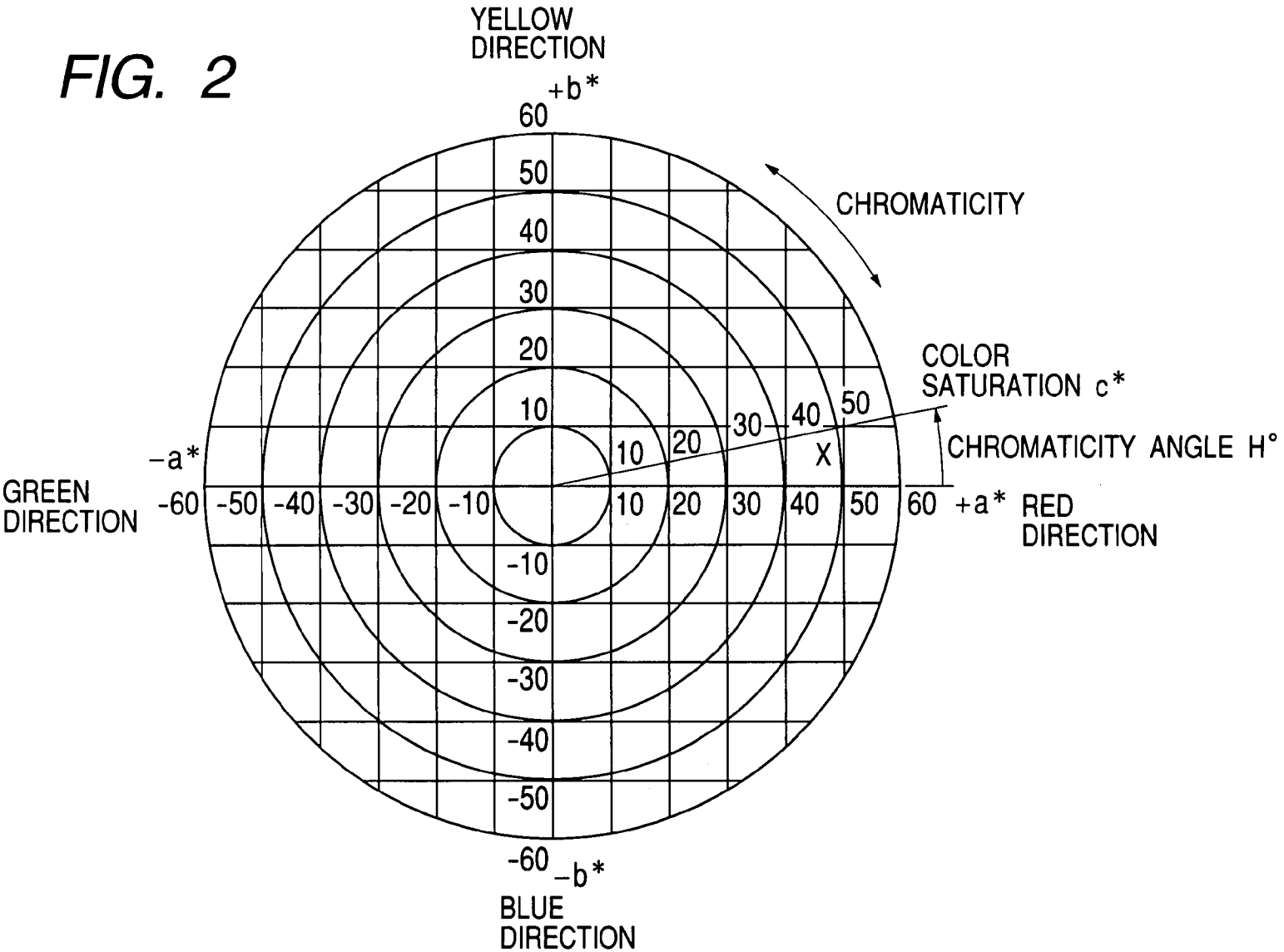
FIG. 2 is a plan conceptional view of chromaticity, color saturation and a chromaticity angle at a certain value of lightness.

FIG. 2 shows a plan conceptional view of the chromaticity, (color saturation) and chromaticity angle at a certain value of lightness. Here, c* means color saturation, and is found from expression (1) below, and indicates the degree of vividness of a. color.

$$C^*=\sqrt{(a^{*2}+b^{*2})} \quad \text{(Expression 1)}$$

Also, the chromaticity angle H° refers to an angle formed by a semi-straight line linking the origin and a point X(a*, b*) together with respect to the +direction of the a* axis in a counter-clockwise direction from the +direction of the a* axis, about a color located at the point X(a*, b*), for example, in a*-b* coordinates. The chromaticity angle can readily represent a particular color phase independently of lightness.

As regards a*, b*, c* and L* of a cyan toner, the toner is introduced, for example, into a commercially available plain paper full-color copying machine (color laser copying machine CLC 1150 produced by Canon Inc.), and plain paper (color laser copier paper TKCLA4 produced by Canon Inc.) is used as an image receiving member, and the amount of toner on the paper is changed to thereby form a 200-line 16-gradation image. The a*, b* and L* of the obtained image are measured by the use of Spectro. Scan Transmission (produced by Gretag macbeth Inc.).

Figure 3:
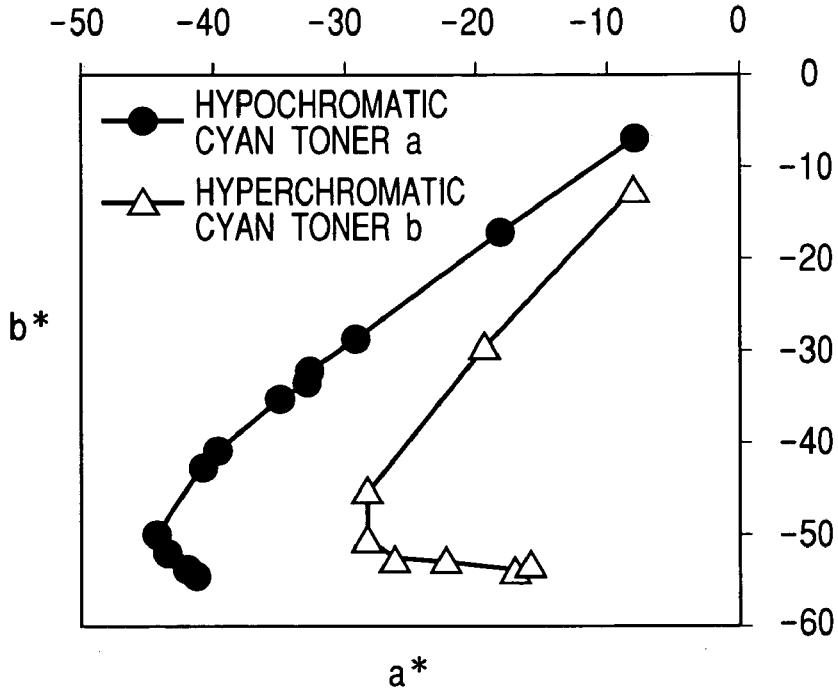
FIG. 3 shows an example of the typical result of the measurement of the chromaticity curves of toners according to an embodiment of the present invention.

The measuring conditions were: an observation light source: D50, an observation field of view: 2°, density: DINNB, white reference: Pap, and a filter: "NO". There is prepared a chart of a*-b* coordinates in which the value of the obtained a* is plotted on the axis of abscissas and the value of the obtained b* is plotted on the axis of ordinates, and from the chart, the values of a* when b* is −20 and when b* is −30 are found. FIG. 3 shows an example of the typical result of the measurement of the chromaticity curve of a toner according to the present embodiment.

Figure 4:
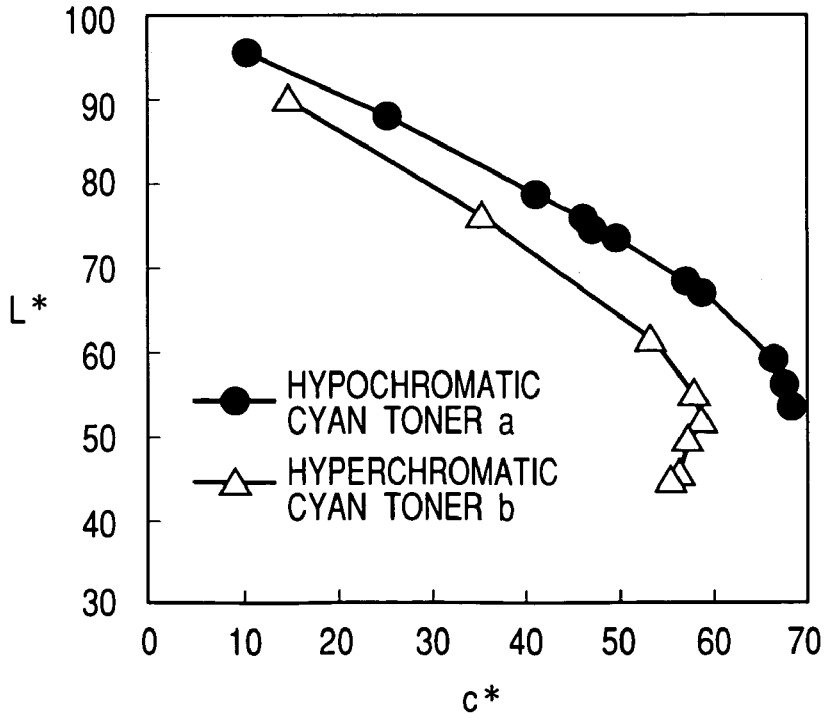
FIG. 4 shows an example of the typical result of the measurement of the color saturation and lightness curves of the toners according to the present embodiment.

Further, the value of c* is found by the use of the aforementioned expression (1), and a chart of L*-c* coordinates in which the value of c* was plotted on the axis of abscissas and the value of L* was plotted on the axis of ordinates was prepared, and from the chart, the value of L* when c* is 30 is found. FIG. 4 shows an example of the typical result of the measurement of the chromaticity and lightness curves of the toner according to the present embodiment.

As described also in Japanese Patent Application No. 2002-144250, when a fixed toner image on plain paper is expressed, use is made of a hypochromatic cyan toner a in which the value (a-1) of a* when b* is −20 is within a range of −19 to −30 and the value (a-2) of a* when b* is −30 is within a range of −29 to −45, and a hyperchromatic cyan toner b in which the value (a-3) of a* when b* is −20 is within a range of −7 to −18 and the value (a-4) of a* when b* is −30 is within a range of −10 to −28, whereby the aforedescribed problem can be solved to thereby obtain a good image which is excellent in gradation property free of grainy feeling from a low density area to a high density area and which has a wide color reproducing range.

Figure 6:
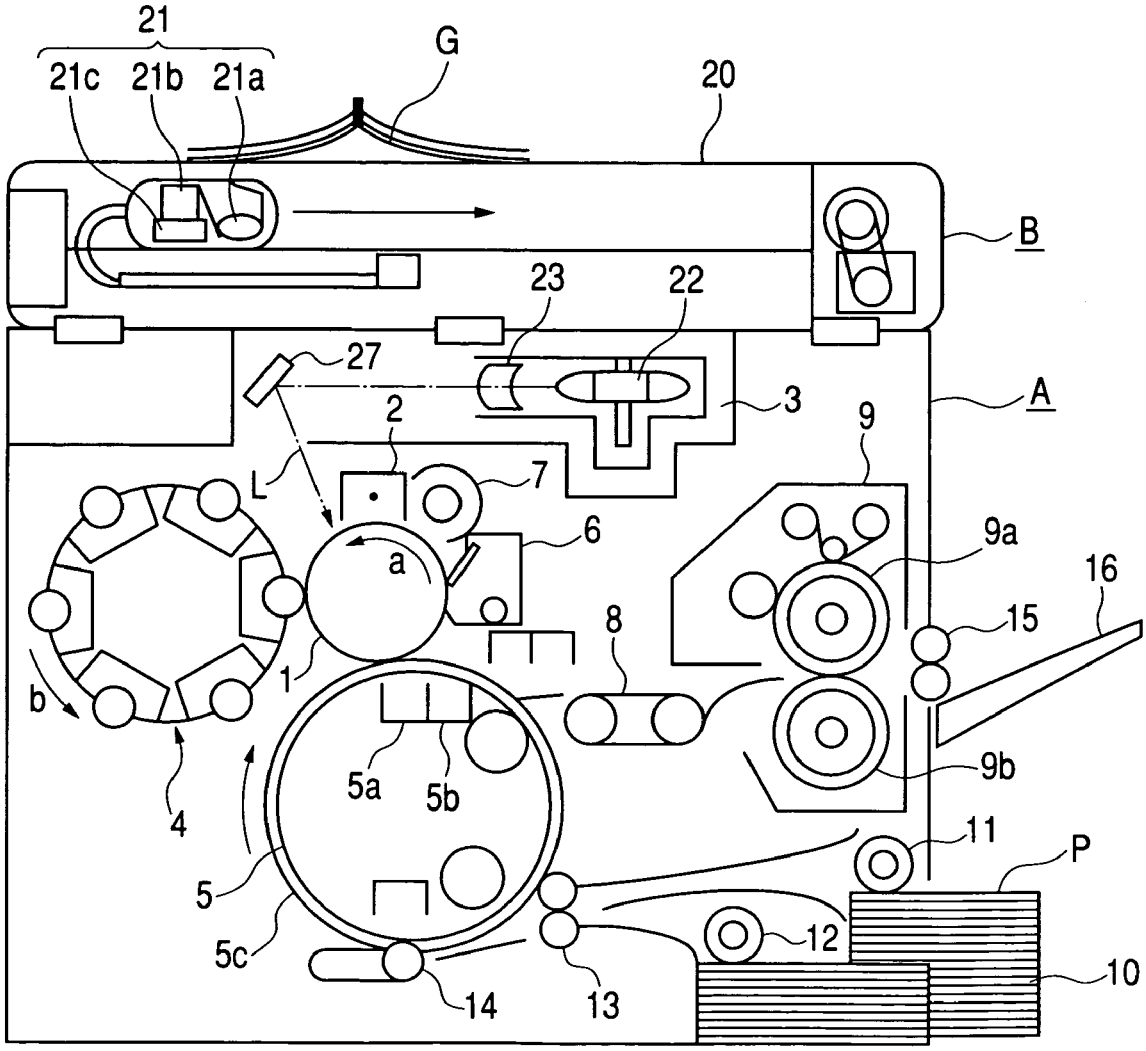
FIG. 6 is a longitudinal cross-sectional view of an image forming apparatus which can be suitably used in the present invention.

So, for the test of a color output of four colors+two colors at this time, with the aforementioned color laser copying machine CLC 1150, produced by Canon Inc., as the base, a laser beam copying machine (usable also as a printer) as a full-color image forming apparatus having a hypochromatic cyan toner, a hyperchromatic cyan toner, a hypochromatic magenta toner, a hyperchromatic magenta toner, a yellow toner and a black toner suitable for the present invention was prepared. FIG. 6 is a longitudinal cross-sectional view of an image forming apparatus which can be suitably used in the present invention. In FIG. 6, the letter A designates a printer portion, and the letter B denotes an image reading portion (image scanner) carried on this printer portion A.

In the image reading portion B, a document G is placed on the upper surface of a fixed document glass stand 20 with the surface thereof to be copied facing downwardly, and is set with a document plate, not shown, being put on it. An image reading unit 21 has a document irradiating lamp 21*a*, a short-focus lens array 21*b*, a CCD sensor 21*c*, etc. located therein.

The image reading unit 21 is forwardly driven along the underside of the document glass stand 20 from the home position on the left side of the document glass stand 20 shown in FIG. 6 to the right side thereof under the document glass stand 20 by a copy button, not shown, being depressed, and is backwardly driven and returned to the initial home position when it arrives at a predetermined terminus of forward movement.

In the forward driving process of the image reading unit 21, the downwardly facing image surface of the document G placed on the document glass stand 20 is sequentially illuminated and scanned from the left side to the right side by the document irradiating lamp 21*a*, and the reflected light of the illuminating scanning light reflected from the surface of the document is imaged by the short-focus lens array 21*b* and enters the CCD sensor 21*c*.

The CCD sensor 21*c* is comprised of a light receiving part, a forwarding part and an output part, not shown, and in the light receiving part, a light signal is changed into a charge signal, and in the forwarding part, the charge signal is sequentially forwarded to the output part in synchronism with a clock pulse, and in the output part, the charge signal is converted into a voltage signal, which is amplified and made low in impedance and is outputted. An analog signal obtained in this manner is converted into a digital signal by well-known image processing and is outputted to the printer portion A. That is, by the image reading portion B, the image information of the document G is photoelectrically read as a time-serial electrical digital pixel signal (image signal).

Figure 8:
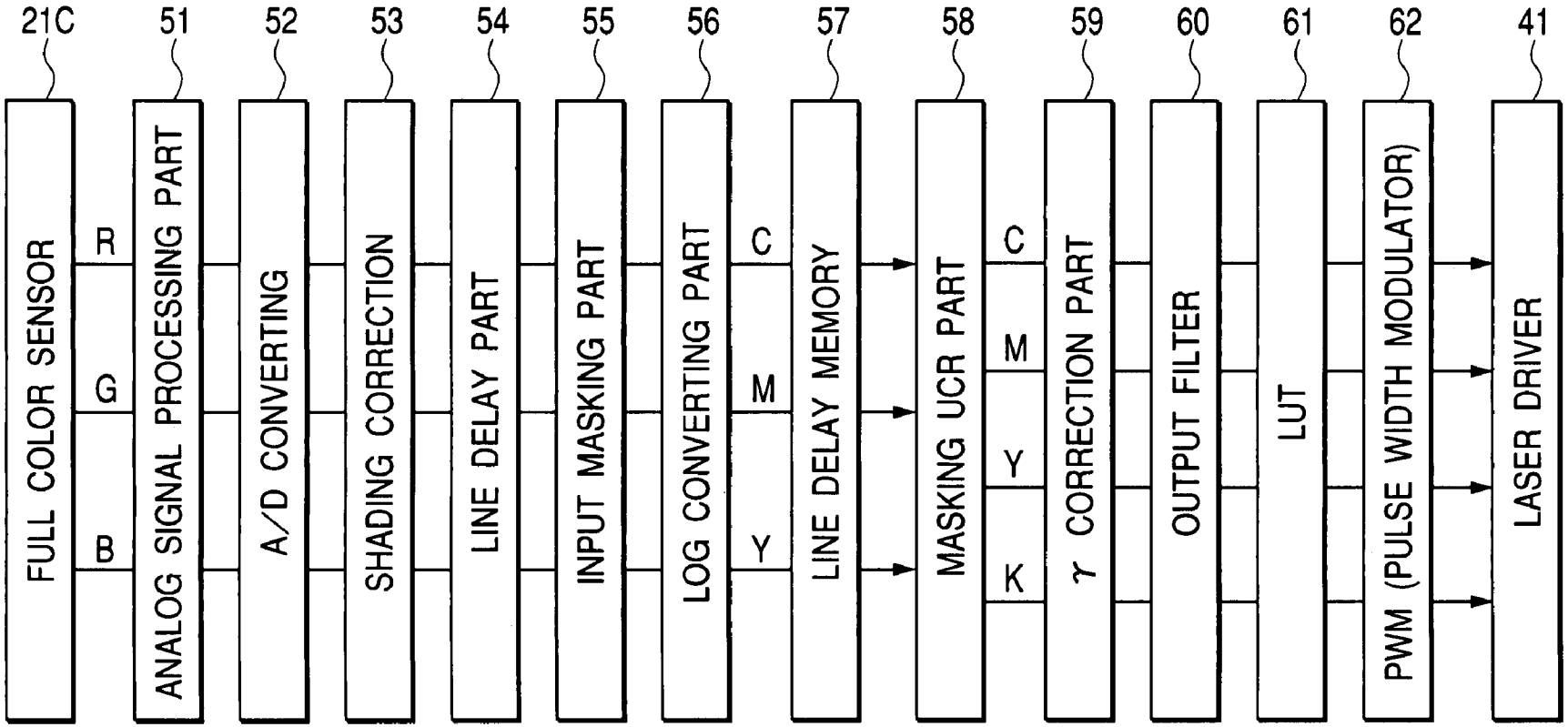
FIG. 8 is a block diagram of image processing in the image forming apparatus according to the present embodiment.

Image processing will now be time-serially described. FIG. 8 shows a block diagram of the image processing in the image forming apparatus according to the present embodiment. In FIG. 8, the image signal outputted from the full-color CCD sensor 21*c* is inputted to an analog signal processing part 51 and has its gain and offset adjusted thereby, whereafter in an A/D converting part 52, for each color component, it is converted into RGB digital signal of e.g. 8 bits (0 to 255 levels: 256 gradations).

A shading correction part 53 effects the known shading correction of optimizing and applying the gain correspondingly to each one CCD sensor cell in order to eliminate the unevenness of the sensitivity of each one of the sensor cell groups of the CCD arranged in a row by the use of a signal having read a reference white plate (not shown) for each color.

A line delay part 54 corrects spatial deviation included in an image signal outputted from the shading correction part 53. This spatial deviation has been caused by the line sensors of the full-color CCD sensor 21*c* being disposed at a predetermined interval in a sub-scanning direction. Specifically, with a B(blue) color component signal as the reference, R(red) and G(green) color component signals are line-delayed in the sub-scanning direction, and the phases of the three color component signals are synchronized with one another.

An input masking part 55 converts the color space of the image signal outputted from the line delay part 54 into a standard color space of NTSC by matrix calculation shown in expression (2) below. That is, the color space of each color component signal outputted from the full-color CCD sensor 21*c* is determined by the spectral characteristic of a filter of each color component, and this is converted into the standard color space of NTSC.

$$\begin{bmatrix} R_0 \\ G_0 \\ B_0 \end{bmatrix} = \begin{bmatrix} a_{11} & a_{12} & a_{13} \\ a_{21} & a_{22} & a_{23} \\ a_{31} & a_{32} & a_{33} \end{bmatrix} \begin{bmatrix} R_i \\ G_i \\ B_i \end{bmatrix} \quad \text{(Expression 2)}$$

where $R_0$, $G_0$, $B_0$: output image signals $R_i$, $G_i$, $B_i$: input image signals A LOG converting part 56 is comprised of a look-up table (LUT) comprising, for example, a ROM or the like, and converts RGB lightness signal outputted from the input masking part 55 into CMY density signal. A line delay memory 57 delays an image signal outputted from the LOG converting part 56 by an amount corresponding to a period (line delay) during which a black character determining part (not shown) produces control signals UCR, FILTER and SEN from the output of the input masking part 55.

A masking UCR part 58 extracts a black component signal K from the image signal outputted from the line delay memory 57, and further, YMCK effects on the signal the matrix calculation of correcting the color turbidity of the recording color material of the printer portion, and a color component image signal of 8 bits in the order of M, C, Y and K during each reading operation of the reader portion. A matrix coefficient used in the matrix calculation is set by a CPU (not shown).

Figure 12:
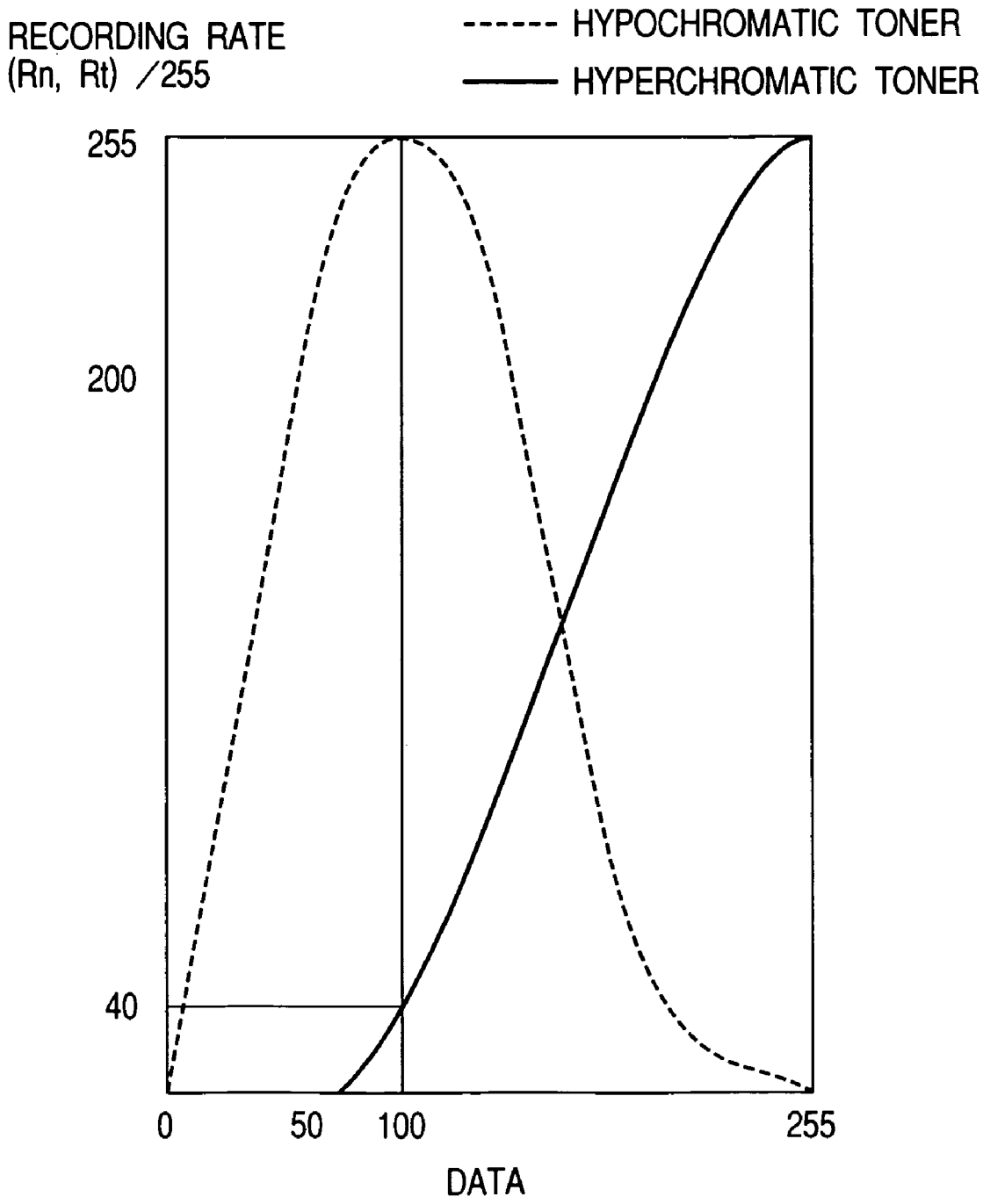
FIG. 12 is a graph showing the relation between the recording rates and gradation data by the hypochromatic toner and hyperchromatic toner according to the present embodiment.

Next, on the basis of a color component image signal Data of 8 bits of the obtained cyan component and magenta component data, the converting process of determining the recording rates Rn and Rt of hyperchromatic dots and hypochromatic dots with reference to such a graph as shown in FIG. 12 which shows the relation between the recording rates and gradation data by the hypochromatic toner and the hyperchromatic toner is carried out. If for example, the inputted gradation data Data of the magenta color or the cyan color is 100/255, the recording rate Rt of the hypochromatic dots is determined as 255/255 and the recording rate Rn of the hyperchromatic dots is determined as 40/255. The recording rate is indicated by an absolute value in which 100 percent is 255. Thus, in a low density area, an image is formed by the hypochromatic toner alone, and in a medium density area, the recording rate of the hypochromatic toner increases and from the intermediate course thereof, the hyperchromatic toner begins to mix with the hypochromatic toner, and in a high density area, the recording rate of the hypochromatic toner decreases and the recording rate of the hyperchromatic toner increases.

A γ correction part 59 effects density-correction on the image signal outputted from the masking UCR part 58 to adjust the image signal to the ideal gradation characteristic of the printer portion. An output filter (space filter processing portion) 60 effects an edge emphasizing or smoothing process on the image signal outputted from the γ correction part 59, in accordance with a control signal from the CPU.

An LUT 61 is for making the density of an original image and the density of an output image coincident with each other, and is comprised, for example, of a RAM or the like, and the conversion table thereof is set by the CPU. A pulse width modulator (PWM) 62 outputs a pulse signal of a pulse width corresponding to the level of the inputted image signal, and the pulse signal is inputted to a laser driver 41 for driving a semiconductor laser (laser beam source).

A pattern generator (not shown) is placed on this image forming apparatus, and a gradation pattern is registered therein so that a signal can be directly delivered to the pulse width modulator 62.

An exposing apparatus 3 which is electrostatic image forming means scans and exposes the surface of a photosensitive member 1 to a laser beam L on the basis of an image signal inputted from the image reading unit 21 to thereby form an electrostatic latent image. That is, if for e.g. the cyan color, a first electrostatic image for hypochromatic cyan and a second electrostatic image for hyperchromatic cyan are discretely formed in succession on the photosensitive member 1.

Figure 10:
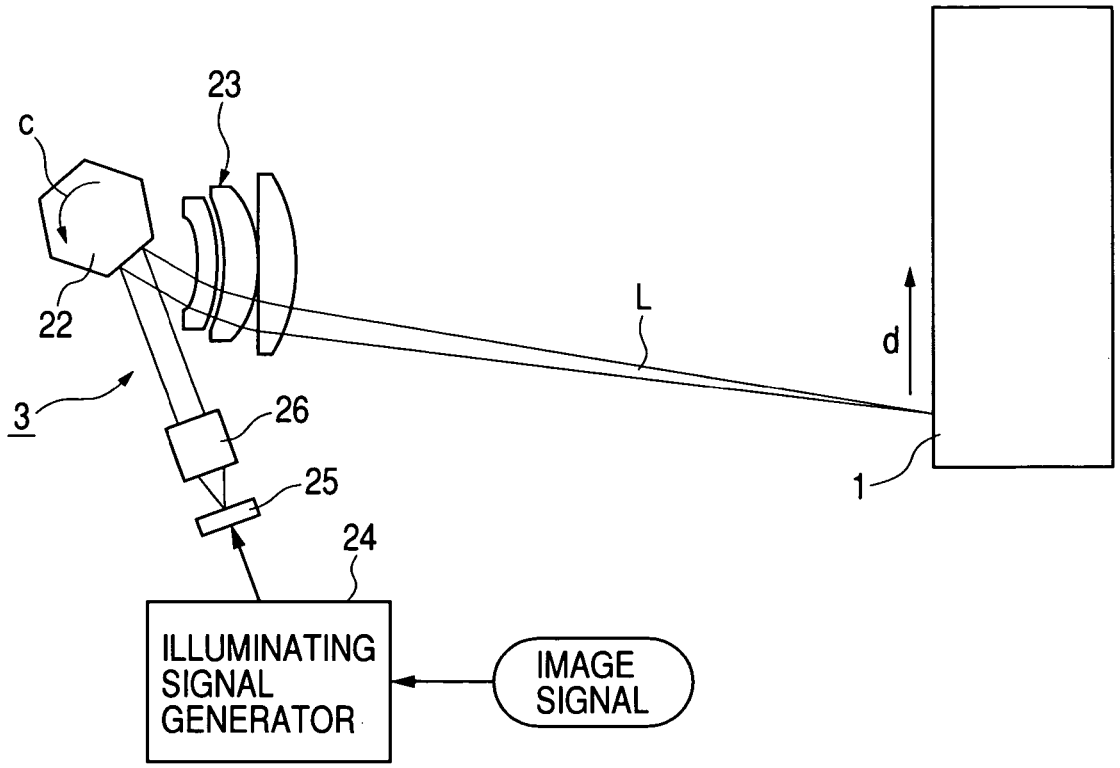
FIG. 10 schematically shows the construction of a laser exposing optical system according to the present embodiment.

FIG. 10 schematically shows the construction of a laser exposing optical system according to the present embodiment. When the surface of the photosensitive member 1 is to be scanned by and exposed to the laser beam L by means of the exposing apparatus 3, a solid state laser element 25 is first turned on and off at predetermined timing an illuminating by signal generator 24 on the basis of the image signal inputted from the image reading unit 21. The laser beam which is a light signal emitted from the solid state laser element 25 is converted into a substantially parallel beam by a collimator lens system 26 and further, the photosensitive member 1 is scanned in the direction of arrow d (lengthwise direction) by a rotary polygon mirror 22 rotated at a high speed in the direction of arrow c, whereby a laser spot is imaged on the surface of the photosensitive member 1 by an fθ lens unit 23 and a reflecting mirror (see FIG. 1). By such laser scanning, an exposure distribution corresponding to the scanning amount is formed on the surface of the photosensitive member 1, and further, if the laser beam is scrolled by a predetermined amount perpendicularly to the surface of the photosensitive member 1 at each scanning, an exposure distribution conforming to the image signal is obtained on the surface of the photosensitive member 1.

That is, the light of the solid state laser element 25 turned on and off correspondingly to the image signal is scanned on the uniformly charged surface (charged to −700V at this time) of the photosensitive member 1 by the rotary polygon mirror 22 rotated at a high speed, whereby electrostatic latent images for respective colors corresponding to the scanning exposure pattern are successively formed on the surface of the photosensitive member 1.

Figure 7:
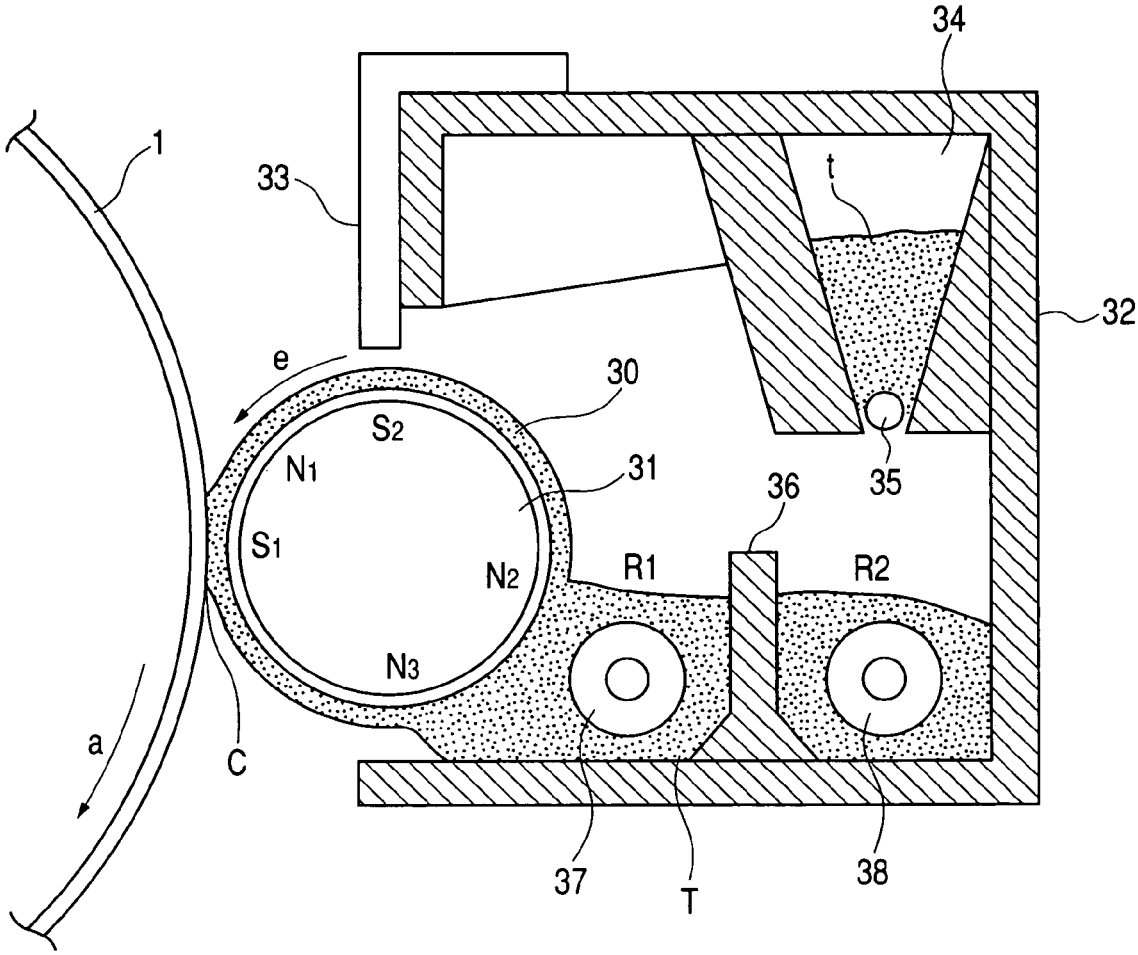
FIG. 7 is a longitudinal cross-sectional view showing the construction of a two-component developing device according to the present embodiment.
Figure 11:
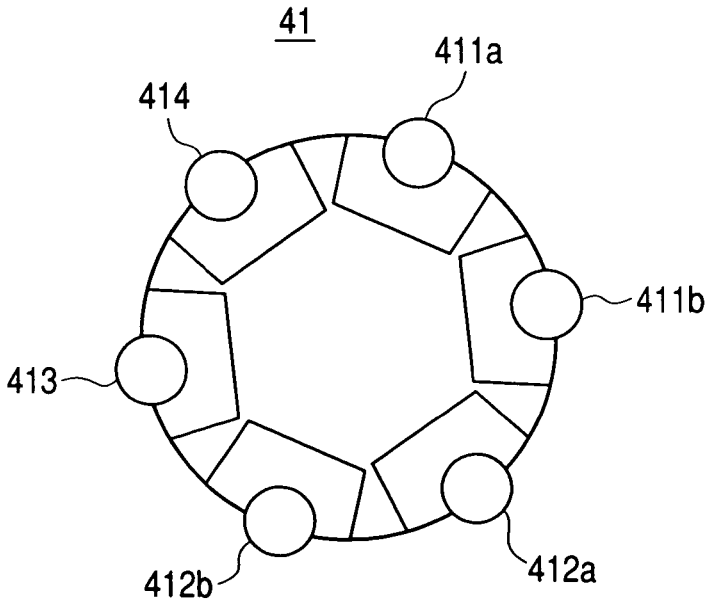
FIG. 11 is a schematic cross-sectional view of a developing apparatus according to the present embodiment.

The construction of a developing apparatus 4 will now be described. FIG. 11 is a schematic cross-sectional view of the developing apparatus according to the present embodiment. As shown in FIG. 11, a developer having a cyan toner a, a developer having a cyan toner b, a developer having a magenta toner a, a developer having a magenta toner b, a developer having a yellow toner, and a developer having a black toner are introduced into developing devices 411*a*, 411*b*, 412*a*, 412*b*, 413 and 414, respectively, and the electrostatic latent images formed on the photosensitive member as an electrostatic latent image bearing member are developed by a magnetic brush developing method, whereby respective color toner images are formed on the photosensitive member 1. As these developing devices, use can be suitably made of such a two-component developing device as shown in FIG. 7. That is, as the developing devices for the hypochromatic toners and the hyperchromatic toners, provision is made of a first developing device 411*a* for the hypochromatic cyan toner, a second developing device 411*b* for the hyperchromatic cyan toner, a first developing device 412*a* for the hypochromatic magenta toner, and a second developing device 412*b* for the hyperchromatic magenta toner.

In FIG. 7, the two-component developing device is provided with a developing sleeve 30 rotatively driven in the direction of arrow e, and a magnet roller 31 is fixedly disposed in the developing sleeve 30. In a developer container 32, there is installed a regulating blade 33 for forming a thin layer of a developer T on the surface of the developing sleeve 30.

Also, the interior of the developer container 32 is comported into a developing chamber (first chamber) R1 and an agitating chamber (second chamber) R2 by a partition wall 36, and a toner hopper 34 is disposed above the agitating chamber R2. Carrying screws 37 and 38 are installed in the developing chamber R1 and the agitating chamber R2, respectively. A supply port 35 is provided in the toner hopper 34, and during toner supply, a toner t is supplied from gravity into the agitating chamber R2 via the supply port 35.

On the other hand, a developer T consisting of a mixture of the toner particles and magnetic carrier particles is contained in the developing chamber R1 and the agitating chamber R2.

The developer T in the developing chamber R1 is carried in the lengthwise direction of the developing sleeve 30 by the rotative driving of the carrying screw 37. The developer T in the agitating chamber R2 is carried in the lengthwise direction of the developing sleeve 30 by the rotative driving of the carrying screw 38. The direction in which the developer is carried by the carrying screw 38 is opposite to the direction by the carrying screw 37.

The partition wall 36 is provided with opening portions (not shown) on the near side and the far side along a direction perpendicular to the plane of the drawing sheet of FIG. 7, and the developer T carried by the carrying screw 37 is delivered to the carrying screw 38 through one of these opening portions, and the developer T carried by the carrying screw 38 is delivered to the carrying screw 37 through the other of the opening portions. The toner is charged to a polarity for developing the latent image, by the friction thereof with the magnetic particles.

The developing sleeve 30 formed of a nonmagnetic material such as aluminum or nonmagnetic stainless steel is provided in an opening portion provided at a region in the developer container 32 which is proximate to the photosensitive member 1, and is rotated in the direction of arrow e (counter-clockwise direction) to thereby carry the developer T consisting of a mixture of the toner and the carrier to a developing portion C. The magnetic brush of the developer T carried on the developing sleeve 30 contacts with the photosensitive member 1 rotated in the direction of arrow a (clockwise direction) in a developing portion C, and the electrostatic latent image is developed by this developing portion C.

A vibration bias voltage comprising a DC voltage superimposed on an AC voltage is applied to the developing sleeve 30 by a voltage source (not shown). The dark portion potential (now exposed portion potential) and light portion potential (exposed portion potential) of the latent image are located between the maximum value and minimum value of the above-mentioned vibration bias potential. Thereby, an alternating electric field alternately changing in direction is formed in the developing portion C. The toner and carrier vibrate vehemently in this alternating electric field, and the toner shakes off electrostatic restraint to the developing sleeve 30 and the carrier and adhered to the light portion of the surface of the photosensitive member 1 correspondingly to the latent image.

It is preferable that the difference between the maximum value and minimum value (peak-to-peak voltage) of the vibration bias voltage be 1 to 5 kV, and in the present embodiment, the vibration bias voltage is of a rectangular wave of 2 kV, and it is preferable that the frequency thereof be 1 to 10 kHz, but in the present embodiment, the frequency is 2 kHz. The waveform of the vibration bias voltage is not restricted to the rectangular wave, but a sine wave, a triangular wave or the like can also be used.

The above-mentioned DC voltage component is of a value between the dark portion potential and light portion potential of the electrostatic latent image, but it is preferable in preventing the adherence of fogged toner to the dark portion potential area that the absolute value thereof be a value more approximate to the dark portion potential than to the minimum light portion potential. In the present embodiment, relative to the dark portion potential of −700 V, the light portion potential was −200V and the DC component of the developing bias was −500V. Also it is preferable that the minimum gap between the developing sleeve 30 and the photosensitive member 1 (the location of this minimum gap is in the developing portion C) be 0.2 to 1 mm, but in the present embodiment, it is 0.5 mm.

Also, it is preferable that the amount of the Developer T regulated and carried to the developing portion C by the regulating blade 33 be such an amount that in a state in which the photosensitive member 1 has been removed, the height, on the surface of the developing sleeve 30, of the magnetic brush of the developer T formed by the magnetic field in the developing portion by the developing magnetic pole S1 of the magnet roller 31 is 1.2 to 3 times as great as the minimum gap value between the developing sleeve 30 and the photosensitive member 1. In the present embodiment, it is 700 μm.

The developing magnetic pole S1 of the magnet roller 31 is disposed at a location opposed to the developing portion C, and the magnetic brush of the developer T is formed by a developing magnetic field formed in the developing portion C by the developing magnetic pole S1, and this magnetic brush contacts with the photosensitive member 1 to thereby develop the dot distribution electrostatic latent image. At that time, both of the toner adhering to the ear (brush) of the magnetic carrier and the toner adhering not to the ear but to the surface of the sleeve shift to the exposed portion of the electrostatic latent image and develop it.

As regards the intensity of the developing magnetic field by the developing magnetic pole S1 on the surface of the developing sleeve (30 magnetic flux density in a direction perpendicular to the surface of the developing sleeve 30), it is preferable that the peak value thereof be $5\times10^{-2}$(T) to $2\times10^{-1}$(T). Also, the magnet roller 31 has poles N1, N2, N3 and S2, besides the above-mentioned developing magnetic pole S1.

Here, description will be made of the developing step of visualizing the electrostatic latent image on the surface of the photosensitive member 1 by a two-component magnetic brush method by the use of the developing apparatus 4, and a circulating system for the developer T.

The developer T scooped up by the pole N2 with the aid of the rotation of the developing sleeve 30 is carried from the pole S2 to the pole N1, and in that course, it has its layer thickness regulated by the regulating blade 33 and forms a thin layer of the developer. Then, the developer T which has eared up in the magnetic field of the developing magnetic pole S1 develops the electrostatic latent image on the photosensitive member 1. Thereafter, by the repulsive magnetic field between the pole N3 and the pole N2, the developer T on the developing sleeve 30 falls into the developing chamber R1. The developer T which has fallen into the developing chamber R1 is agitated and carried by the carrying screw 37.

Description will now be made of transferring means according to the present embodiment. In the present invention, a popular material can be used for an intermediate transferring member and transferring means.

A transferring member 5 has a transferring sheet 5*c* comprising, for example, polyethylene terephthalate resin film extended on the surface thereof, and is installed for contact with and separation from the photosensitive member 1. The transferring member 5 is rotatively driven in the direction of arrow (clockwise direction). In the transferring member 5, there are installed a transferring charger 5*a*, a separating charger 5*b*, etc.

Description will now be made of the image forming operation of the above-described image forming apparatus.

The photosensitive member 1 is rotatively driven at a predetermined peripheral speed (process speed) in the direction of arrow a (counter-clockwise direction) about the central support shaft thereof, and in the rotation process thereof, it is subjected to a uniform charging process of the negative polarity in the present embodiment by a primary charger 2.

Then, by the scanning and exposure by a laser beam L modulated correspondingly to an image signal outputted from the image reading portion B to the printer portion A side which is outputted from the exposing apparatus (laser scanning apparatus) 3 to the uniformly charged surface of the photosensitive member 1, electrostatic latent images of respective colors corresponding to the image information of a document G photoelectrically read by the image reading portion B are successively formed on the photosensitive member 1. One of the electrostatic latent images formed on the photosensitive member 1 is first reversal-developed by the developing device 411*a* of the developing apparatus 4 by the above-described two-component magnetic brush method and is visualized as a toner image of a first color.

On the other hand, transferring materials P such as paper contained in a sheet supply cassette 10 are fed one by one by a sheet feeding roller 11 or 12 in synchronism with the forming of the above-mentioned toner image on the photosensitive member 1, and the fed transferring material P is supplied to the transferring member 5 at predetermined timing by registration rollers 13, and is electrostatically attracted onto the transferring member 5 by an attracting roller 14. The transferring material P electrostatically attracted onto the transferring member 5 is moved to a location opposed to the photosensitive member 1 by the rotation of the transferring member 5 in the direction of arrow (clockwise direction), and charges opposite in polarity to the aforementioned toner are imparted to the back side of the transferring material P by the transferring charger 5*a*, whereby the toner image on the photosensitive member 1 is transferred to the front side of the transferring material P.

After this transfer, any untransferred toner residual on the photosensitive member 1 is removed by a cleaning apparatus 6, and is used for forming the next toner image.

Thereafter, the electrostatic latent images on the photosensitive member 1 are developed in the same manner, and a cyan toner a image, a cyan toner b image, a magenta toner image a, a magenta toner image b, a yellow toner image and a black toner image are superimposed and transferred onto the transferring material P which is a recording medium on the transferring member 5 by the transferring charger 5*a*, whereby a full-color image is formed.

The image forming means for thus forming the toner images onto the recording medium has the charger 2, the exposing apparatus 3, the developing apparatus 4, the transferring member 5 and the transferring charger 5*a*.

The transferring material P is then separated from the transferring member 5 by the separating charger 5*b*, and the separated transferring member P is transported to a fixing apparatus 9 through a transporting belt 8. The transferring material P transported to the fixing apparatus 9 goes thereinto at about 200 mm/s, and is heated at about 160° C. and pressurized at 70 kg between a fixing roller 9*a* (silicone rubber: thickness 2.4 mm, Ø 60 mm, hardness 79 (ASK-(1 kg load)) and a pressure roller 9*b* (silicone rubber: thickness 1.8 mm, Ø 60 mm, hardness 81 (ASK-(1 Kg load) and the full-color image is fixed on the surface of the transferring material P, whereafter the transferring material P is discharged onto a tray 16 by sheet discharging rollers 15.

Any untransferred toners on the surface of the photosensitive member 1 are removed by the cleaning apparatus 6 and further, any charges on the surface of the photosensitive member 1 are eliminated by an ante-exposure lamp 7, whereafter the photosensitive member 1 is ready for the next image forming.

The characteristic portion of the present invention will now be described in greater detail. In order to confirm the effect of the present invention, a patch output is effected with respect tot he cyan color as shown in FIG. 5A. First, as shown in FIG. 12, latent image writing of a recording rate 100% (255/255) of a hypochromatic toner and a recording rate 15% (40/255) of a hyperchromatic toner is effected for an input data value 100, and a developing process is carried out with the DC component of a developing bias to be normally effected, whereby a toner image T1 is formed on the transferring material.

At this time, the laser spot diameter was shaken by the insertion of a stop into a collimator portion, and the minimum dot size W mini (see FIG. 5B) of the hyperchromatic toner in the hypochromatic toner on the paper was changed from 20 μm to 70 μm, and the graininess of the image T1 was subjectively evaluated to thereby examine whether there was any problem in the gradation property from the hypochromatic toner to the hyperchromatic toner. The recording rate of the hyperchromatic toner was set at 1/16. This value "1/16" is a value set because it is a point at which the grainy feeling of the hyperchromatic toner is visually easily understandable. In the case of a value smaller than this "1/16", the grainy feeling is difficult to visually understand and therefore, it is appropriate to set the recording rate at "1/16".

FIG. 5A is a typical view of an image patch in which the hyperchromatic toner and the hypochromatic toner are mixedly present, FIGS. 5B, 5C and 5D show an example of the definition of the minimum dot size Wmini of the hyperchromatic toner. That is, FIGS. 5B, 5C and 5D show examples of the pattern of the image on the transferring material when the recording rate of the hyperchromatic toner is "1/16". When an elliptical or circular dot is formed as shown in FIG. 5B, the minimum dot size Wmini is the length of the minor axis of the ellipse or circle. When a line image is formed as shown in FIG. 5C or 5D, the minimum dot size Wmini is a line width. Which of the patterns shown in FIGS. 5B, 5C and 5D is formed when the recording rate of the hyperchromatic toner is "1/16" is preset by the image forming apparatus.

Also, the aforedescribed evaluation of graininess is changed also by the density difference between the hypochromatic toner and the hyperchromatic toner and therefore, it was also practised at the same time to shake the lightness L* value when the recording rate of the hypochromatic toner was 100% (255/255).

The result is shown in FIG. 9. From this, it has been found that particularly, the dot diameter of the hyperchromatic toner on the transferring material does not exceed 50 μm, whereby the aggravation of graininess at the time when the hyperchromatic toner gets mixed in the solid portion of the hypochromatic toner, particularly when the hyperchromatic toner gets mixed for the first time in an image formed by the hypochromatic toner, can be prevented. Of course, although depending also on the density of the hypochromatic toner, for the achievement of a reduction in the roughness of hilight which is the first purpose of introducing the hypochromatic toner, it is known that in the present embodiment, the lightness value when the recording rate of the hypochromatic toner is 100% can exceed 60. That is, under a condition which is effective for the roughness of hilight, unless the dot diameter of the hyperchromatic toner on the paper exceeds 50 μm, a reduction in the roughness of hilight and a reduction in the graininess when for the first time, the hyperchromatic toner gets mixed in the image formed by the hypochromatic toner are compatible.

Actually, the clear shape of a toner image exceeding 50 μm when the recording rate of the hyperchromatic toner is 1/16 gives a malaise to the image, and when the toner is scattered on the transferring material and the image is blurred, no problem is posed. That is, "a toner image exceeding 50 μm" does not exist. The minimum size of 50 μm is that on the transferring material, and does not coincide with the resolution of the apparatus. Accordingly, even if the resolution is 600 dpi (42.3 μm per dot), the minimum size is not always 50 μm.

A method of adjusting the dot diameter is not restricted to the technique of changing the laser spot diameter as in the present embodiment, but it is also possible as by changing the scanning time in the aforedescribed PWM in a pixel.

That is, it is preferable that when the recording rate of the hyperchromatic toner is 1/16, the minimum dot size Wmini of the hyperchromatic toner in the hypochromatic toner on the transferring material be 50 μm or less.

The developing means is not restricted to rotary type developing means provided with a plurality of developing apparatuses for a photosensitive member, but may be developing means called an in-line color type provided with a developing apparatus for each photosensitive member. That is, in such case, provision is made, for example, six photosensitive members and six developing devices corresponding thereto.

Also, the method of interposing the toner images one upon another is not restricted to a method of successively superimposing a plurality of toner image on the transferring material, but may be, for example, a method of successively superimposing toner images on an intermediate transferring member, and thereafter collectively transferring them onto the transferring material.

Also, the toner images of plural colors are not always limited to Y, M, C and K colors.

According to the present invention, in an image forming apparatus, hyperchromatic and hypochromatic toners are used, and the minimum dot size Wmini of the hyperchromatic toner in the hypochromatic toner on a transferring material is prevented from exceeding 50 μm, whereby a reduction in the graininess in an image area wherein the hypochromatic toner and the hyperchromatic toner are mixedly present can be achieved, and smooth gradation expression in all gradation areas becomes possible.

What is claimed is:

1. An image forming apparatus having:

image forming means for forming an image on a transferring medium by a use of a hypochromatic toner and a hyperchromatic toner of substantially the same color, said image forming means including developing means for developing with said hypochromatic toner and said hyperchromatic toner;

wherein, in an image area in which the hyperchromatic toner and the hypochromatic toner are mixedly present, in the case that recording rate of the hyperchromatic toner is 1/16, a minimum size of a toner image of the hyperchromatic toner is 50 μm or less on the transferring medium.

2. An image forming apparatus according to claim 1, wherein, in the case that recording rate of said hyperchromatic toner is 1/16, if the toner image of the hyperchromatic toner is of a line image type, the minimum size is the same as a line width thereof.

3. An image forming apparatus according to claim 1, wherein, in the case that the recording rate of said hyperchromatic toner is 1/16, if the toner image of the hyperchromatic toner is of an elliptical or circular dot image type, the minimum size is the same as a length of a minor axis thereof.

4. An image forming apparatus according to claim 1, wherein the developing means is provided with a first developing device for effecting development with the hypochromatic toner, and a second developing device for effecting development with the hyperchromatic toner.

5. An image forming apparatus according to claim 1, wherein the image forming apparatus converts image data of the same color into image data for the hypochromatic toner and image data for the hyperchromatic toner, and has electrostatic image forming means for forming a first electrostatic image based on the image data for the hypochromatic toner, and a second electrostatic image based on the image data for the hyperchromatic toner.

6. An image forming apparatus according to claim 1, wherein the transferring medium is plain paper, and, in the case that a fixed toner image on a plain paper is represented as L*a*b* color system, the hypochromatic toner is a cyan toner in which the value of a* when b* is −20 is within a range of −19 to −30, and the value of a* when b* is −30 is within a range of −29 to −45, and the hyperchromatic toner is a cyan toner in which a value of a*, in the case that b* is −20, is within a range of −7 to −18, and the value of a*, in the case that b* is −30, is within a range of −10 to −28.

7. An image forming apparatus according to claim 1, wherein a lightness value, in the case that the recording rate of said hypochromatic toner is 100%, is greater than 60.

* * * * *

UNITED STATES PATENT AND TRADEMARK OFFICE

CERTIFICATE OF CORRECTION

PATENT NO. : 7,343,112 B2
APPLICATION NO. : 10/760316
DATED : March 11, 2008
INVENTOR(S) : Nobuyuki Ito et al.

It is certified that error appears in the above-identified patent and that said Letters Patent is hereby corrected as shown below:

ON THE TITLE PAGE:

At Item (56), References Cited, FOREIGN PATENT DOCUMENTS, Line 10, "2004133381" should read --2004-133381--.

IN THE DRAWINGS:

At Sheet 8, FIG. 9, "HILIGHT" should read --HIGHLIGHT--.

COLUMN 1:

Line 10, "forming" should read --formed--.
Line 23, "(e.g." should read --(e.g.,--.
Line 49, "hilight" should read --highlight--.
Line 51, "granuation" should read --granulation--.
Line 52, "hilight" should read --highlight--.

COLUMN 2:

Line 46, "noize" should read --noise--.
Line 60, "hilight" should read --highlight--.

COLUMN 4:

Line 4, "FIGS. 5A" should read --FIG. 5A--.
Line 61, "a." should read --a--.

COLUMN 5:

Line 13, "Spectro." should read --Spectro--.

COLUMN 6:

Line 40, "e.g." should read --e.g.,--.

COLUMN 8:

Line 5, "e.g." should read e.g.,--.

COLUMN 12:

Line 21, "tot he" should read --to the--

UNITED STATES PATENT AND TRADEMARK OFFICE

CERTIFICATE OF CORRECTION

PATENT NO. : 7,343,112 B2
APPLICATION NO. : 10/760316
DATED : March 11, 2008
INVENTOR(S) : Nobuyuki Ito et al.

It is certified that error appears in the above-identified patent and that said Letters Patent is hereby corrected as shown below:

COLUMN 13:

Line 5, “hilight” should read --highlight--.
Line 10, “hilight,” should read --highlight,--.
Line 12, “hilight” should read --highlight--.

COLUMN 14:

Line 11, “toner;” should read --toner,--.

Signed and Sealed this

Second Day of September, 2008

JON W. DUDAS
*Director of the United States Patent and Trademark Office*